US009797672B2

(12) United States Patent
Wilson

(10) Patent No.: US 9,797,672 B2
(45) Date of Patent: Oct. 24, 2017

(54) TUNABLE MUZZLE COMPENSATOR FOR A FIREARM

(71) Applicant: Brian Wilson, Boca Raton, FL (US)

(72) Inventor: Brian Wilson, Boca Raton, FL (US)

( * ) Notice: Subject to any disclaimer, the term of this patent is extended or adjusted under 35 U.S.C. 154(b) by 0 days.

(21) Appl. No.: 15/068,727

(22) Filed: Mar. 14, 2016

(65) Prior Publication Data

US 2017/0023326 A1 Jan. 26, 2017

Related U.S. Application Data

(63) Continuation-in-part of application No. 14/845,514, filed on Sep. 4, 2015, now Pat. No. 9,562,734.

(60) Provisional application No. 62/104,726, filed on Jan. 17, 2015.

(51) Int. Cl.
*F41A 21/38* (2006.01)

(52) U.S. Cl.
CPC ..... *F41A 21/38* (2013.01)

(58) Field of Classification Search
CPC ..... F41A 21/36; F41A 21/26; F41A 21/28
USPC ..... 42/79, 1.06; 89/14.05, 14.2–14.5
See application file for complete search history.

(56) References Cited

U.S. PATENT DOCUMENTS 2,712,193 A * 7/1955 Mathis ..... F41A 21/42 42/79
2,916,970 A * 12/1959 Mutter ..... F41A 21/00 89/14.3
3,115,060 A * 12/1963 Ashbrook ..... F41A 21/36 89/14.3
3,698,747 A * 10/1972 Wing ..... F16L 37/144 285/305
6,899,008 B2 * 5/2005 Breuer ..... F41A 21/36 89/14.2

* cited by examiner

*Primary Examiner* — Reginald Tillman, Jr.
(74) *Attorney, Agent, or Firm* — Clifford H. Kraft

(57) ABSTRACT

A tunable muzzle compensator for a weapon such as a firearm that includes a tube that extends the barrel of the weapon by fitting over the muzzle or is directly integrated into the barrel. This center tube, or modified barrel includes one or more holes along its length. One or more removable sections that have gas exit ports at various predetermined angles fit over the center section. Removable sections can be rotated to either turn off top holes on the center tube or to choose different angles of gas discharge The total effect of all the removable sections represents a particular tuning for the weapon. The weapon can be very quickly tuned on the range or in the field to compensate for weight of the projectile, the charge, and the shooting style by simply replacing and/or reversing removable sections with sections that have different angles of discharge.

9 Claims, 5 Drawing Sheets

TUNABLE MUZZLE COMPENSATOR FOR A FIREARM

This is a continuation-in-part of application Ser. No. 14/845,514 filed Sep. 4, 2015 which claimed priority from U.S. Provisional Patent Application No. 62/104,726 filed Jan. 1, 2015. Application Ser. Nos. 14/845,514 and 62/104,726 are hereby incorporated by reference in their entireties.

BACKGROUND

Field of the Invention

The present invention relates generally to accessories for firearms and more particularly to a tunable muzzle compensator for a firearm.

Description of the Prior Art

A muzzle compensator is a device that fits onto the barrel of a rifle or pistol that is adapted to allow a portion of the discharged gas to exit the compensator at some angle to the axis of the barrel. This has the effect of providing a force on the barrel that acts as a lever arm to compensate for both the backward recoil and the muzzle climb movement caused by firing the weapon. Muzzle climb is an upward movement of the barrel of the weapon as the projectile moves through the barrel and exits that causes the barrel to climb and move sideways. This is due to the lever created by the back-force on the gun by the explosion in the chamber and the shooter's contact points on the weapon. Muzzle climb pulls the boresight off the target causing the projectile to not hit where the weapon was originally aimed. A properly sized and positioned compensator can keep the boresight of the barrel dead on target even though the weapon tends to kick upward and somewhat sideways.

There are several muzzle compensators on the market. Most compensators are fixed and factory adjusted for particular weapons. A model supplied by Ares Armor can be tuned by adding or removing screws in rows of slots around the circumference of the compensator. While this model is effective, it is in general and overkill since it has numerous ports that are closed off with screws and never used. It would be advantageous to have a muzzle compensator that could be tuned to a particular weapon, particular ammunition and a particular shooter by adding or subtracting one or more removable sections.

SUMMARY OF THE INVENTION

The present invention relates to tunable muzzle compensators that can be used with both pistols and rifles. A compensator includes a tube that extends the barrel of the weapon by fitting over the muzzle. This center tube includes a one or more holes along its length. One or more removable sections or washers that have gas exit ports at various predetermined angles fit over the center section. Some of the removable sections can be inverted to force the gas in an opposite direction. The total effect of all the removable sections represents a particular tuning for the weapon. The weapon can be tuned by replacing and/or reversing removable sections with sections that have different angles of discharge. This process can be quickly accomplished on the range or in the field. An end section acts as the final exit point for the bullet or other projectile or projectiles and holds the removable sections or washers on the center section. Embodiments of the present invention may also be integrated into a gun barrel and not limited to size or caliber or gauge and not limited to rifles or pistols or shotguns.

DESCRIPTION OF THE FIGURES

Attention is now directed to several figures that illustrate features of the present invention.

Several illustrations and drawings have been presented to aid in understanding the present invention. The scope of the present invention is not limited by what is shown in the Figures.

DESCRIPTION OF THE PREFERRED EMBODIMENT

The present invention relates to a muzzle compensator and brake that includes a one or more thick washers or sections that can be removed and replaced individually with different gas discharge angles to divert the exit gasses at various angles to return the weapon to a zero point keeping it stable and on-target. The system can rapidly tune a firearm in the field.

Figure 1:
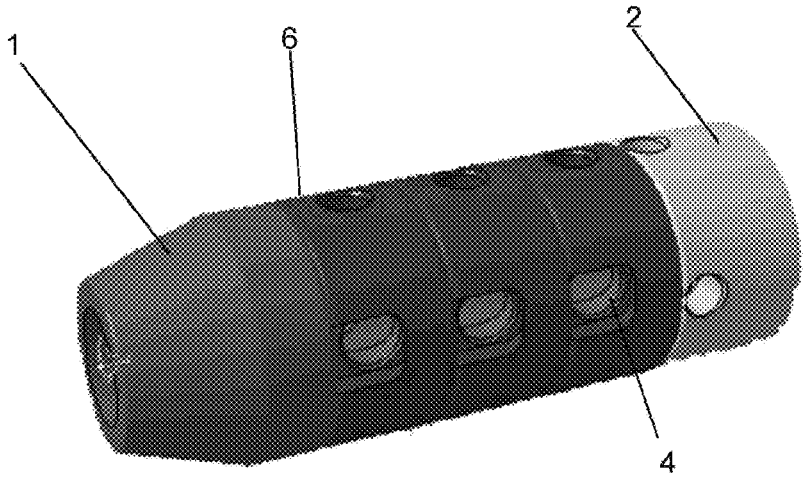
FIG. 1 shows an assembled view of an embodiment of the present invention used with a rifle.

Turning to FIG. 1, an embodiment of the present invention for use with a rifle is shown. The compensator has a center section that includes an elongated tube much like an extension of the weapon's barrel. A front end 1 has a threaded hole that screws onto the muzzle of the pistol. While screwing is the preferred mounting method for the compensator, any way of mounting the compensator to the end of the barrel is within the scope of the present invention.

Figure 2:
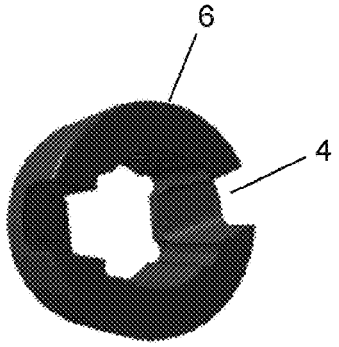
FIG. 2 shows one of the removable sections from the embodiment of FIG. 1.

One or more removable washers or sections 6, each having one or more gas exit ports 4 are removably inserted onto the center section. FIG. 2 shows an enlargement of a typical removable section 6 or tuning washer with two gas ports 4. Each removable section 6 is designed to fit on the compensator and to allow compressed gas to exit at a chosen angle. Different removable sections can be supplied that direct gasses at different angles for tuning.

Figure 3:
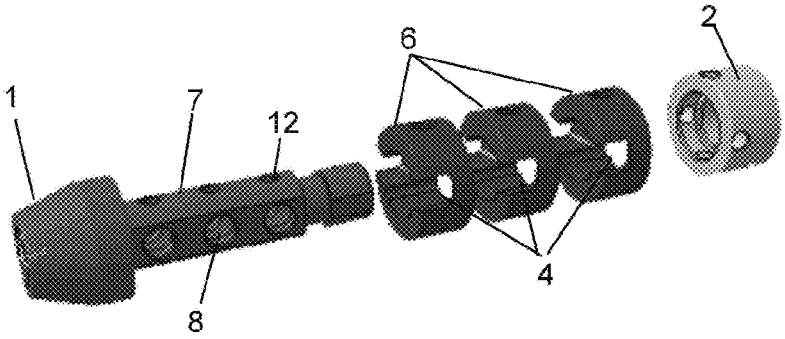
FIG. 3 shows an exploded view of the embodiment of FIG. 1.

FIG. 3 shows details of a typical center section. As stated with respect to FIG. 1, a front end piece 1 attaches to the muzzle of the weapon. The center section includes an elongated tube 7 with top gas exit ports 12 and side gas exit ports 8 spaced along the elongated tube 7. In a preferred configuration, there are at least three sets of gas exit ports along the elongated tube 7. An end piece 2 can be attached to the distal end of the elongated tube 7 to hold the removable sections 6 in place. Each removable section 6 can be keyed to match a key or the shape of the elongated tube 7 so that, once mounted, it cannot rotate. Each removable section 6 includes one or more angled gas exit ports 4.

Different removable sections 6 can have different gas exit angles allowing the weapon to be tuned by replacing a section with one angle by a section with a different angle.

Figure 4:
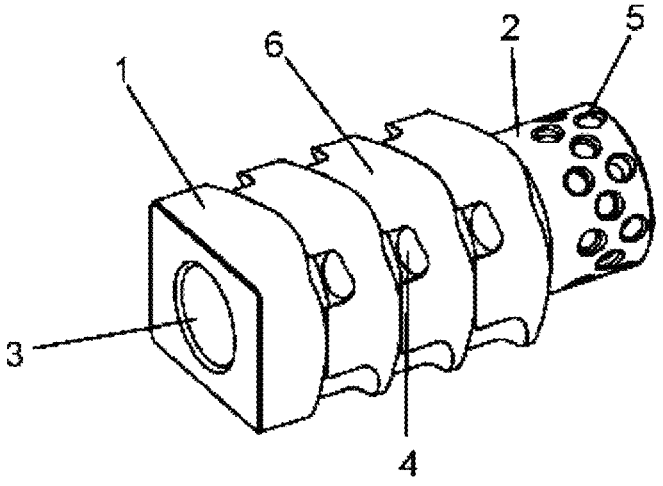
FIG. 4 shows an assembled view of an embodiment of the present invention used with a pistol.
Figure 5:
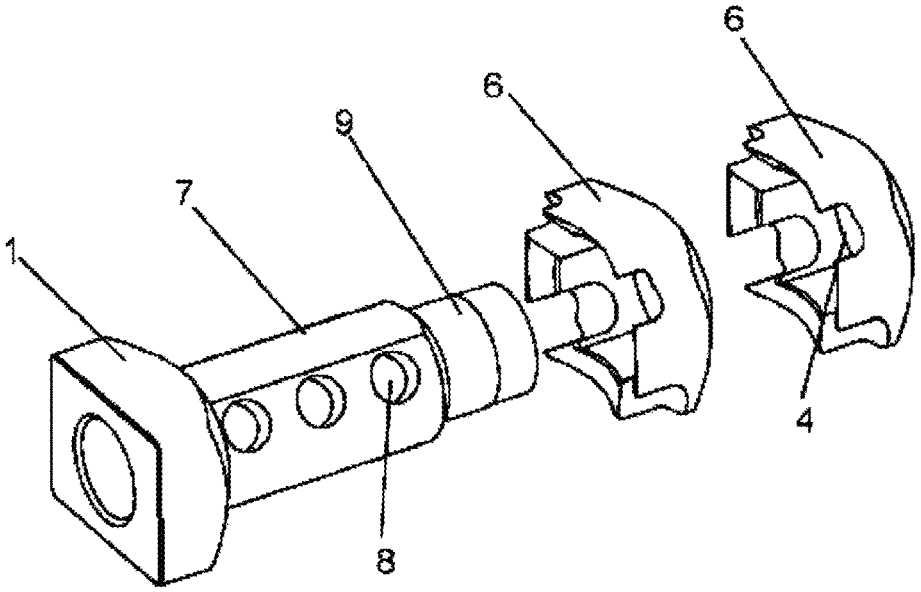
FIG. 5 shows an exploded view of the embodiment of FIG. 4.

FIGS. 4-5 show an embodiment of the present invention designed for use on a pistol. Again, a front end 1 attaches to the muzzle of the weapon. An elongated tube 7 contains one or more gas exit ports 8. One or more removable sections 6 each contain one or more gas exit ports 4 set at a predetermined angle. The elongated center section 7 terminates in an end post 9. After all of the removable sections 6 are in place, an end piece 2 with optional counter-sunk holes 5 can hold the removable sections 6 in place.

The removable sections or washers 6 have two more different angles machined into each section. Examples are 15-20, 25-30 or 35-40 degrees. These numbers represent the angle which the section diverts the high pressure gas after the gun has been discharged. When the section is placed on the center section, only the top ports are used. The bottom ports are turned off. There are typically two ports of each angle on each section. Rotating the section 180 degrees causes the second angle to be selected rather than the first angle. Either angle may be used.

The first removable tuning section in FIG. 5 shows the top 20 degree ports turned on and the bottom 15 degree ports turned off. The second or more distal section shows the top 15 degree ports turned on and the bottom 20 degree ports turned off. These can be adjusted by turning or replacing the sections.

Figure 6:
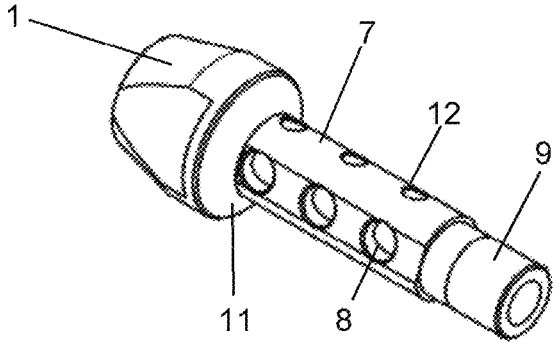
FIG. 6 shows a different embodiment of the center section of a compensator that can be used with a rifle.
Figure 7:
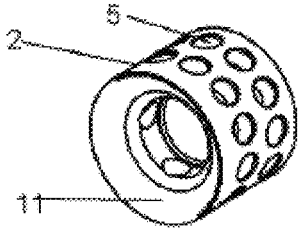
FIG. 7 shows an end section used with the embodiment of FIG. 6.

FIGS. 6-7 show a different embodiment of the center section and the end piece 2. The front end 1 can have an inner beveled interface 11 as can the end piece 2. Again, the end piece 2 can have a plurality of counter-sunk holes 5.

Figure 8A:
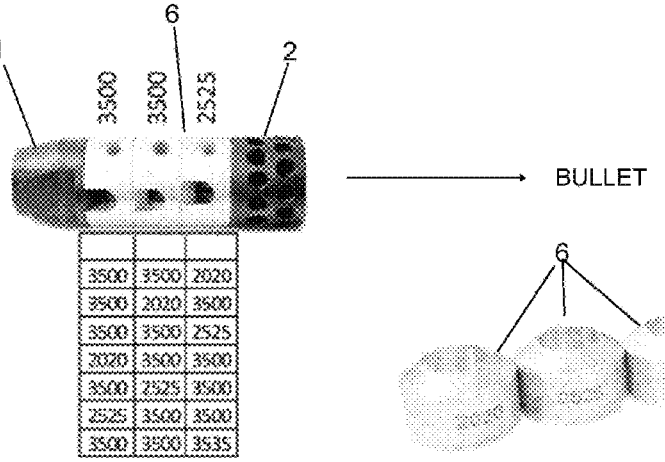
FIGS. 8A-8E shows assembled compensators of the embodiment of FIGS. 6-7 that are tuned for different amounts of compensation.

FIGS. 8A-8E show the rifle embodiment of FIGS. 6-7 assembled with different levels of compensation. As can be seen in FIG. 8A, the bullet or other projectile or projectiles pass from left to right in the figure through the device from the front end 1 to the exit piece 2.

Compensation for each removable section 6 is typically specified by a four-digit number. The first two digits specify recoil compensation; the second two digits specify muzzle rise compensation. In this specification scheme, the larger the number, the more force applied to the muzzle.

As the rear of the bullet or projectile passes through the device, it passes the first removable section. Here the pressure is at its highest. As it passes the second removable section, the pressure is less (since some of the gas escaped through the ports in the first removable section). Finally, as the rear of the projectile passes the third removable section, the pressure is considerably less than it was at the first section. Thus, an identical port in a different position along the device exerts decreasing force as its position moves toward the exit end of the compensator. In the case of rise compensation. Thus moving a removable section from the distal end of the device (low pressure) to the middle position results in more downward force on the muzzle, or if moved to the first position (high pressure) more downward force yet.

Figure 8D:
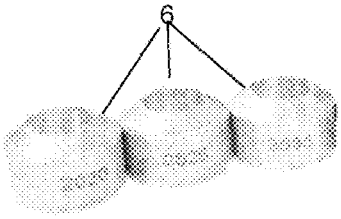
Figure 8B:
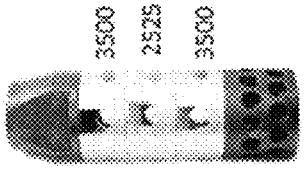
Figure 8C:
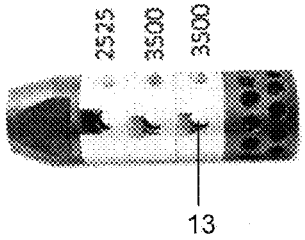

FIG. 8A shows a chart of different possible tuning configurations that can be achieved with three removable sections 6. The actual part shown has 3500 for the high pressure section, 3500 for the middle section and 2525 for the low pressure end section. FIG. 8B shows the same device reconfigured for 3500, 2525 and 3500. FIG. 8C shows a configuration for 2525, 3500 and 3500. The change in tuning can be made in minutes in the field, and can be adjusted until the weapon is fully compensated. Different side ports have different predetermined angles with respect to the central axis; top ports can have different sizes to adjust for muzzle rise, or they can be adjusted by moving sections fore and aft. Any number of ports and any possible angles are within the scope of the present invention. Also, some of the removable sections have no top ports. These have 00 value in lift compensation.

Figure 8E:
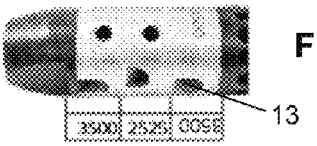

Removable sections with 00 in the lift compensation can be installed in a reverse configuration (rotated 180 degrees, or reversed, so that the ports face the opposite direction along the central barrel axis with respect to the direction of projectile travel). This allows force to be applied in the opposite direction to fine tune recoil compensation. With this type of section installed, the top holes are typically closed off. For example, FIG. 8C shows the low pressure distal section installed so that the port 13 is facing away from the exit section, while FIG. 8E shows the section reversed so the port is facing toward the exit section. This feature allows very fine tuning. FIG. 8D shows three stock center sections 2020, 2525 and 3535. As can be seen, the recoil compensation on these parts is 20, 25 and 35. This is accomplished with different angled side ports. The rise compensation on these parts is 20, 25 and 35. This can be done with different sized holes, or by placing the same sized section at a different location fore or aft as previously explained. Any number of differently configured removable sections is within the scope of the present invention.

In general, the removable sections or washers are one or more devices that have gas exit ports that can slide over the compensator barrel. Each device has a series of ports and/or slots that redirect gasses when the firearm is discharged. The present invention is the only system where the user can change the direction and force of the pressurized gas without removing and reinstalling a different compensator. The expulsion of gas diverted by the removable sections at predetermined angles allows the tuning of a firearm with respect to the weight of the projectile, the power charge and the shooting style of the user.

It should be noted that when referring to the central axis of the gun barrel and the compensator or the direction of projectile travel, a forward direction is away from the shooter, and a rearward direction is toward the shooter.

It should also be noted that while the present description has concentrated on rifles and pistols, the present invention can be used with any firearm including shotguns, gas discharge pellet guns, and other types of weapons or firearms. Use with any firearm or gas discharge weapon is within the scope of the present invention.

Figure 9:
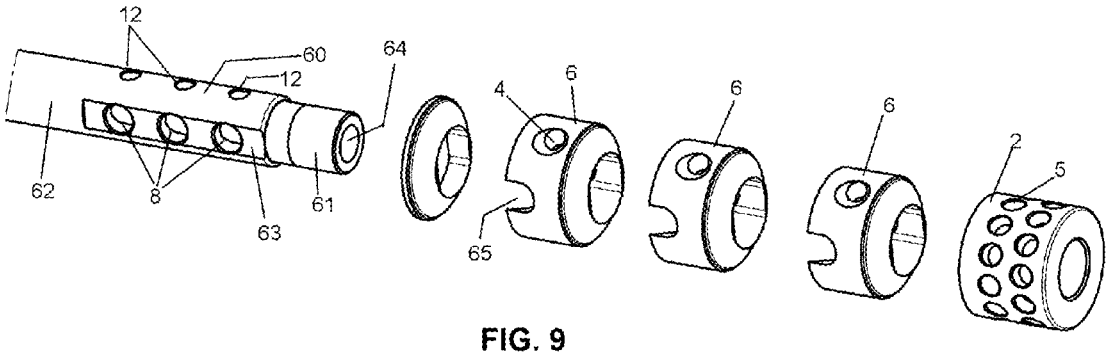
FIG. 9 shows an exploded view of an embodiment that is integrated with a gun barrel.
Figure 10:
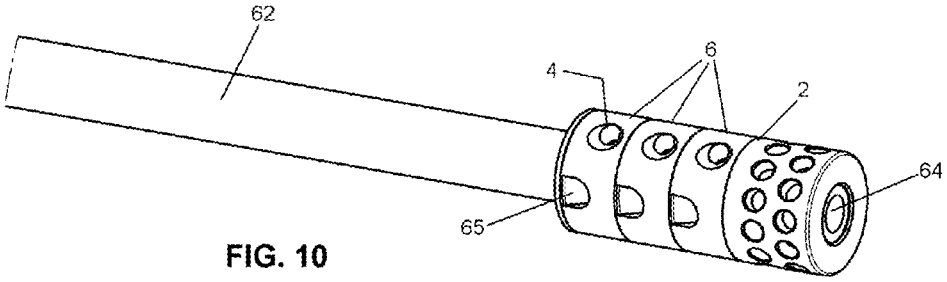
FIG. 10 shows the embodiment of FIG. 9 assembled.

FIG. 9 shows an exploded view of an embodiment of the present invention integrated with a gun barrel 62. FIG. 10 shows the embodiment of FIG. 9 assembled on the barrel 62. A barrel, which can belong to a rifle, pistol, shotgun, pellet gun or any other weapon or firearm, is shown in FIGS. 9-10. The forward part of the barrel 60 has a series of smaller holes 12 and a recessed area 63 with a series of larger gas exit ports 8. The most forward end of the barrel 61 is simply an extension of the barrel 62 with a muzzle hole for projectile exit 64.

Similar to previous embodiments, one or more removable sections 6 each contain one or more top gas exit ports 4 set at a predetermined angle, and one or more side exit ports 65 also set to a predetermined angle. After all of the removable sections 6 are in place, an end piece 2 with optional counter-sunk holes 5 can hold the removable sections 6 in place. The system can be keyed or un-keyed for rotation of the removable sections for tuning. This embodiment works on the same principle as previous embodiments, but is fully integrated into the weapon. Again, the present invention is not limited to rifles, pistols or shotguns, but may be used with any type of gas discharge weapon.

Several descriptions and illustrations have been presented to aid in understanding the present invention. One with skill in the art will realize that numerous changes and variations may be made without departing from the spirit of the invention. Each of these changes and variations is within the scope of the present invention.

I claim:

1. A tunable muzzle compensator comprising:

a gun barrel with a central axis and a distal end having three top gas exit holes on an outer surface, and six side gas exit holes also on the outer surface near the distal end, three side gas exit holes on each side of the gun barrel, each side gas exit hole in opposition to a corresponding side gas exit hole on the other side of the gun barrel, the gun barrel receiving and holding three removable washer sections;

a collection of substantially cylindrical removable washer sections, each alignable fore and aft with the top and side gas exit holes on the gun barrel, each washer section having at least one top port and two side ports, the side ports on a each particular washer section all having a predetermined rearward angle with respect to the central axis to compensate for recoil, the top port on each particular washer section also having predetermined angle with respect to the central axis to compensate for muzzle rise.

2. The tunable muzzle compensator of claim 1 further comprising three bottom gas exit holes opposed to the top gas exit holes on the gun barrel.

3. The tunable muzzle compensator of claim 2 wherein the removable tuning sections have top ports at a first angle with respect the central axis and further include bottom ports at a second angle with respect to the central axis, the first angle being different than the second angle.

4. The tunable muzzle compensator of claim 3 wherein the removable tuning sections are rotatable 180 degrees about the central axis to select between the first angle and the second angle.

5. The tunable muzzle compensator of claim 4 wherein at least some of the removable tuning sections can be mounted in a rotated configuration on the barrel to direct at least some of the expelled gas in a forward direction with respect to projectile travel.

6. The tunable muzzle compensator of claim 5 wherein some of the removable sections direct gas partially along a rearward direction with respect to the central axis and some of removable sections direct gas partially in a forward direction with respect to projectile travel.

7. A tunable muzzle compensator comprising: a gun barrel with a central axis and a distal end having three top gas exit holes on an outer surface, and six side gas exit holes also on the outer surface near the distal end, three side gas exit holes on each side of the gun barrel, each side gas exit hole in opposition to a corresponding side gas exit hole on the other side of the gun barrel, the gun barrel receiving and holding three removable washer sections;

a collection of three stock substantially cylindrical removable washer sections, each aligned fore and aft with top and side gas exit holes on the gun barrel, each washer section having one top port and two side ports, the side ports on a each particular washer section all having a predetermined angle with respect to the central axis to compensate for recoil, the top port on each particular washer facing upward to compensate for muzzle rise;

wherein a user can tune the weapon for recoil and rise by choosing different stock removable washer sections with different predetermined angles.

8. The tunable muzzle compensator of claim 7 wherein removable washer sections can be reversed on the central axis to direct expelled gas in an opposite direction with respect to projectile travel.

9. The tunable muzzle compensator of claim 7 further comprising an end part adapted to hold one or more selected removable washer sections on the elongated shaft.

* * * * *